US006895942B2

(12) United States Patent
Iitaka et al.

(10) Patent No.: US 6,895,942 B2
(45) Date of Patent: May 24, 2005

(54) ENGINE FUEL PUMP MOUNTING STRUCTURE

(75) Inventors: Satoshi Iitaka, Wako (JP); Kazuhiro Yamamoto, Wako (JP)

(73) Assignee: Honda Giken Kabushiki Kaisha, Tokyo (JP)

( * ) Notice: Subject to any disclaimer, the term of this patent is extended or adjusted under 35 U.S.C. 154(b) by 292 days.

(21) Appl. No.: 09/923,914

(22) Filed: Aug. 8, 2001

(65) Prior Publication Data

US 2002/0035989 A1 Mar. 28, 2002

(30) Foreign Application Priority Data

Aug. 11, 2000 (JP) ..... 2000-245015

(51) Int. Cl.[7] ..... F02M 37/04; F02F 7/00
(52) U.S. Cl. ..... 123/509; 123/195 A
(58) Field of Search ..... 123/509, 470, 123/508, 507, 495, 195 A, 198 C

(56) References Cited

U.S. PATENT DOCUMENTS 4,054,108 A * 10/1977 Gill ..... 123/54.4
4,516,546 A * 5/1985 Choushi et al. ..... 123/195 A
4,662,320 A * 5/1987 Moriya ..... 123/41.44
4,708,097 A * 11/1987 Hatamura et al. ..... 123/184.36
5,490,488 A * 2/1996 Aversa et al. ..... 123/568.12
6,148,787 A * 11/2000 Takano ..... 123/195 A
6,170,471 B1 * 1/2001 Yonezawa et al. ..... 123/508
6,237,547 B1 * 5/2001 Ishiyama ..... 123/41.31
6,405,711 B1 * 6/2002 Smith et al. ..... 123/456

FOREIGN PATENT DOCUMENTS

JP 11-82159 3/1999

* cited by examiner

*Primary Examiner*—Carl S. Miller
(74) *Attorney, Agent, or Firm*—Armstrong, Kratz, Quintos, Hanson & Brooks, LLP

(57) ABSTRACT

A rocker shaft holder that supports a rocker shaft and a camshaft holder that supports an intake camshaft and an exhaust camshaft in association with the rocker shaft holder are superimposed and connected to each other on the upper surface of a cylinder head, and a fuel pump that supplies fuel at high pressure to an injector is driven by a journal on a shaft end of the exhaust camshaft. The fuel pump is fastened to the cylinder head by means of a bolt; to the integral type camshaft holder, in which a plurality of bearings are integrally connected together via connecting parts, by means of a bolt; and to the rocker shaft holder by means of bolts, and the rigidity of that parts on which the fuel pump is mounted is thereby enhanced to reliably support the camshaft and the rocker shaft.

24 Claims, 8 Drawing Sheets

ENGINE FUEL PUMP MOUNTING STRUCTURE

BACKGROUND OF THE INVENTION

1. Field of the Invention

The present invention relates to an engine fuel pump mounting structure in which a camshaft holder that supports a camshaft is fixed to the upper surface of a cylinder head, and a fuel pump is mounted on a shaft end of the camshaft.

2. Description of the Related Art

With regard to an engine in which a fuel pump that supplies fuel at high pressure to an injector is driven by a shaft end of a camshaft, one in which a pump housing of the fuel pump is bolted so as to extend over both a cylinder head and a camshaft holder is known in Japanese Patent Application Laid-open No. 11-82159.

In general, when a pump housing of a fuel pump that is driven by a camshaft is bolted to a cylinder head and a camshaft holder, since the rigidity of the camshaft holder, which is a comparatively small member that is provided so as to support each of the journals of the camshaft, is insufficient, there is a possibility that the heavy fuel pump might not be reliably supported.

SUMMARY OF THE INVENTION

The present invention has been carried out in view of the above-mentioned circumstances, and it is an object of the present invention to enhance the rigidity with which a fuel pump that is driven by a camshaft is supported.

In order to achieve the above-mentioned object, in accordance with a first aspect of the present invention, there is proposed an engine fuel pump mounting structure in which a camshaft holder that supports a camshaft is fixed to an upper surface of a cylinder head and a fuel pump is mounted on a shaft end of the camshaft, wherein the camshaft holder is formed by integrally connecting together a plurality of bearings that support the camshaft via connecting parts, and the fuel pump is fastened to the camshaft holder by a bolt.

In accordance with the above-mentioned arrangement, since the camshaft holder to which the fuel pump is fastened by the bolt has a highly rigid integral structure in which the plurality of bearings that support the camshaft are integrally connected together via the connecting parts, both the rigidity with which the camshaft is supported and the rigidity with which the fuel pump is supported by the camshaft holder can be enhanced.

Furthermore, in accordance with a second aspect of the present invention, there is proposed an engine fuel pump mounting structure in which a rocker shaft holder that supports a rocker shaft and a camshaft holder that supports a camshaft alone, or in association with the rocker shaft holder, are superimposed on the upper surface of a cylinder head and a fuel pump is mounted on a shaft end of the camshaft, wherein the camshaft holder is formed by integrally connecting together a plurality of bearings that support the camshaft via connecting parts and the fuel pump is fastened to each of the cylinder head, the rocker shaft holder and the camshaft holder by a bolt.

In accordance with the above-mentioned arrangement, since the fuel pump is fastened by a bolt to each of the three members consisting of the cylinder head, the rocker shaft holder and the camshaft holder, the rigidity of these three members can be enhanced effectively by a pump housing of the fuel pump, and the camshaft and the rocker shaft can be supported reliably. In particular, since the camshaft holder has an integral structure in which the plurality of bearings that support the camshaft are connected integrally together via the connecting parts, the rigidity of the camshaft holder is further increased, and, as a result, the camshaft can be supported more reliably while enhancing the rigidity with which the fuel pump is supported.

In accordance with a third aspect of the present invention, there is proposed an engine fuel pump mounting structure in which a camshaft holder that supports a camshaft is fixed to the upper surface of a cylinder head and a fuel pump is mounted on a shaft end of the camshaft, wherein a bearing provided on the camshaft holder and a fuel pump mounting boss provided on the camshaft holder are connected to each other via a reinforcing rib.

In accordance with the above-mentioned arrangement, since the bearing provided on the camshaft holder and the fuel pump mounting boss provided on the camshaft holder are connected to each other via the reinforcing rib, the rigidity with which the fuel pump is supported can be enhanced by the integral connection of the bearing and the fuel pump mounting boss on the camshaft holder.

In addition to any one of the above-mentioned first to third aspects, a fuel pump mounting boss formed on the cylinder head and an outer wall of an EGR gas passage formed in the cylinder head are connected to each other via a reinforcing rib, and the rigidity of the fuel pump mounting boss can thereby be enhanced so supporting the fuel pump yet more reliably.

In addition to either one of the above-mentioned first aspect or second aspect, a reinforcing rib extending in the direction toward where the fuel pump is mounted is provided on a reverse surface of a fuel pump mounting boss formed on the camshaft holder, and it is thereby possible to suppress downward movement of the camshaft holder due to the weight of the fuel pump and enhance the rigidity with which the fuel pump and the camshaft are supported.

In addition to the above-mentioned third aspect, the reinforcing rib that connects the bearing of the camshaft holder to the fuel pump mounting boss is extended from the reverse side of the fuel pump mounting boss in the direction toward where the fuel pump is mounted, and it is thereby possible to suppress downward movement of the camshaft holder due to the weight of the fuel pump and enhance the rigidity with which the fuel pump and the camshaft are supported.

The above-mentioned objects, and other objects, characteristics and advantages of the present invention will become apparent from explanation of a preferred embodiment that will be described in detail below by reference to the attached drawings.

BRIEF DESCRIPTION OF THE DRAWINGS

FIG. 1 is a cross sectional view of a cylinder head of a direct fuel injection engine.

FIG. 2 is an end view of the engine from the same direction as in FIG. 1.

FIG. 3 is a view showing the engine of FIG. 2 in a state in which the fuel pump has been removed.

FIG. 4 is a cross sectional view taken along a line 4—4 in FIG. 2.

FIG. 5 is an enlarged view taken in the direction of arrow 5 in FIG. 1.

FIG. 6 is a cross sectional view taken along a line 6—6 in FIG. 5.

FIG. 7 is a cross sectional view taken along a line 7—7 in FIG. 5.

FIG. 8 is an enlarged cross sectional view taken along a line 8—8 in FIG. 1.

DESCRIPTION OF PREFERRED EMBODIMENT

The embodiment of the present invention is explained below by reference to the attached drawings.

Figure 1:
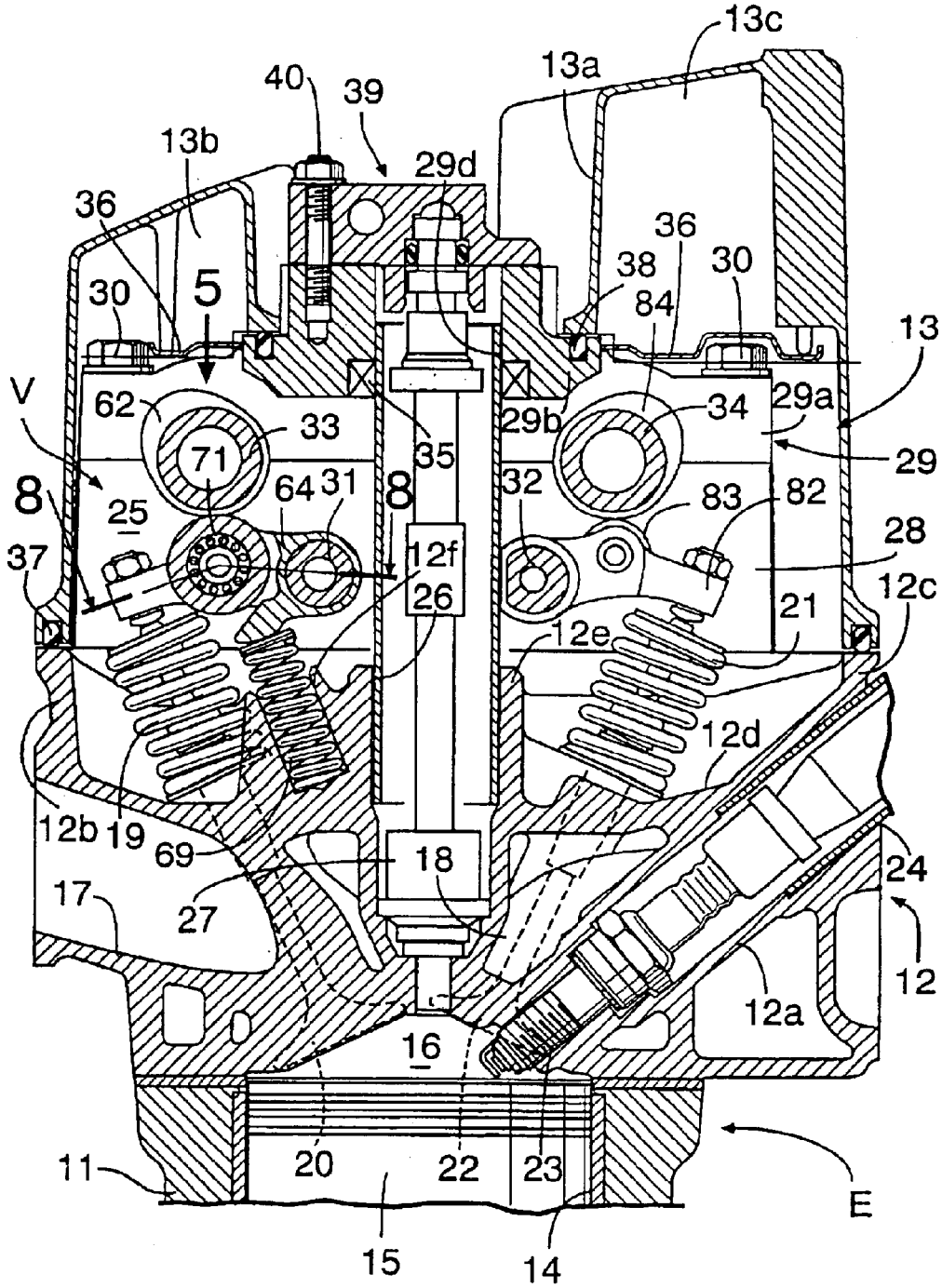
FIGS. 1 to 8 illustrate one embodiment of the present invention.

FIG. 1 is a cross section of an in-line four cylinder engine E. A cylinder head 12 is connected to the upper surface of a cylinder block 11, and a head cover 13 is connected to the upper surface of the cylinder head 12. A piston 15 is supported in a cylinder 14 formed in the cylinder block 11 in a slidable manner, and a conical form of combustion chamber 16 formed on the lower surface of the cylinder head 12 faces the top surface of the piston 15. A pair of intake ports 17 and a pair of exhaust ports 18 open inside the combustion chamber 16. The intake ports 17 are opened and closed by a pair of intake valves 20, which are forced in the closing direction by means of valve springs 19. The exhaust ports 18 are opened and closed by a pair of exhaust valves 22, which are forced in the closing direction by means of valve springs 21.

An ignition plug insertion tube 12*a* is formed in the cylinder head 12 on the exhaust side so as to make an angle to the cylinder axis, and the tip of an ignition plug 23 mounted within the insertion tube 12*a* faces the combustion chamber 16. The cylinder head 12 includes a cylinder head side wall 12*b* on the intake side and a cylinder head side wall 12*c* on the exhaust side. An extension pipe 24, which is press-fitted into the ignition plug insertion tube 12*a*, extends outward from the cylinder head side wall 12*c* on the exhaust side. A valve operation cam chamber 25 is formed between the cylinder head 12 and the head cover 13. A boss-form injector mounting base 12*e* is formed on a valve operation cam chamber deck surface 12*d* forming the base of the valve operation cam chamber 25 so as to surround the cylinder axis. An injector 27 is housed within an injector pipe 26, which is press-fitted into the injector mounting base 12*e*, and the lower end of the injector 27 provided in the injector mounting base 12*e* faces the top part of the combustion chamber 16.

Figure 2:
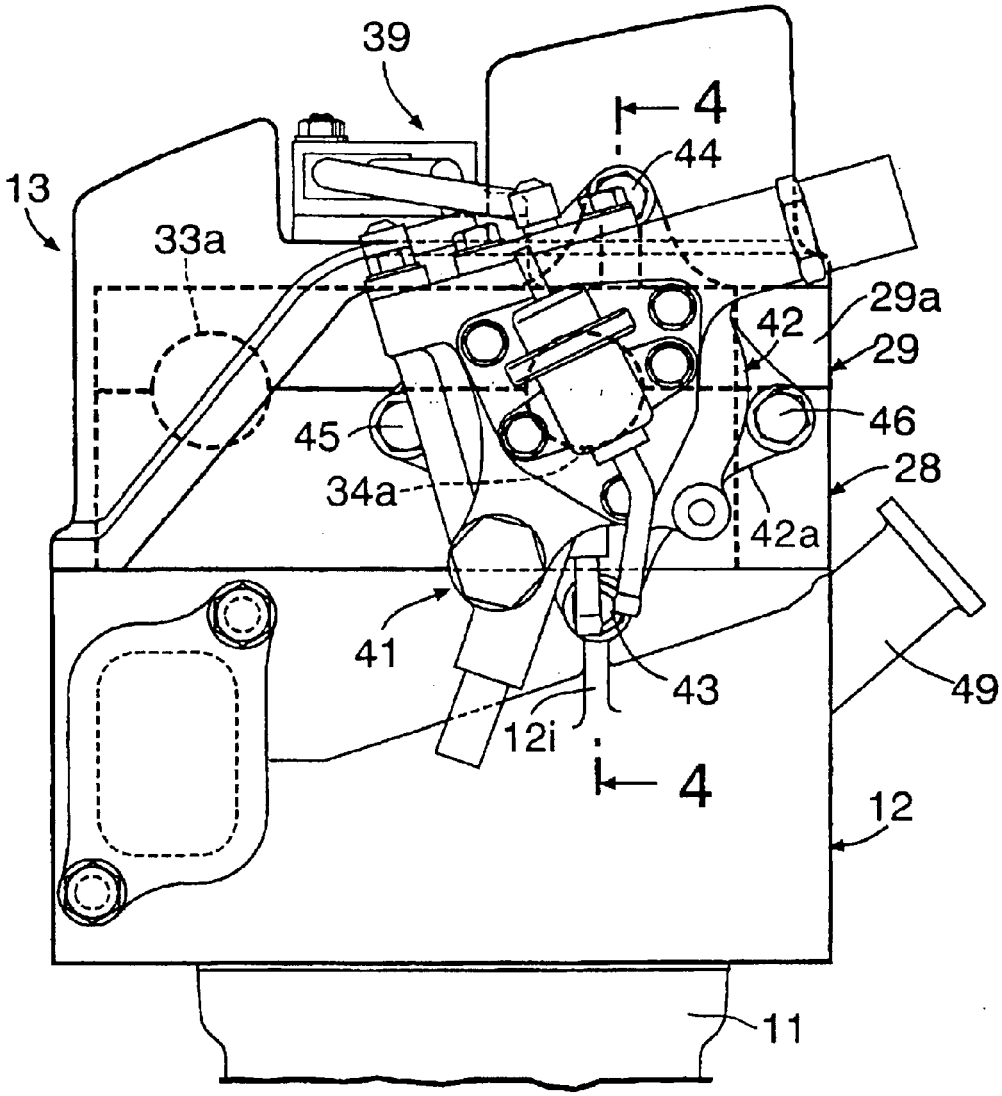
Figure 3:
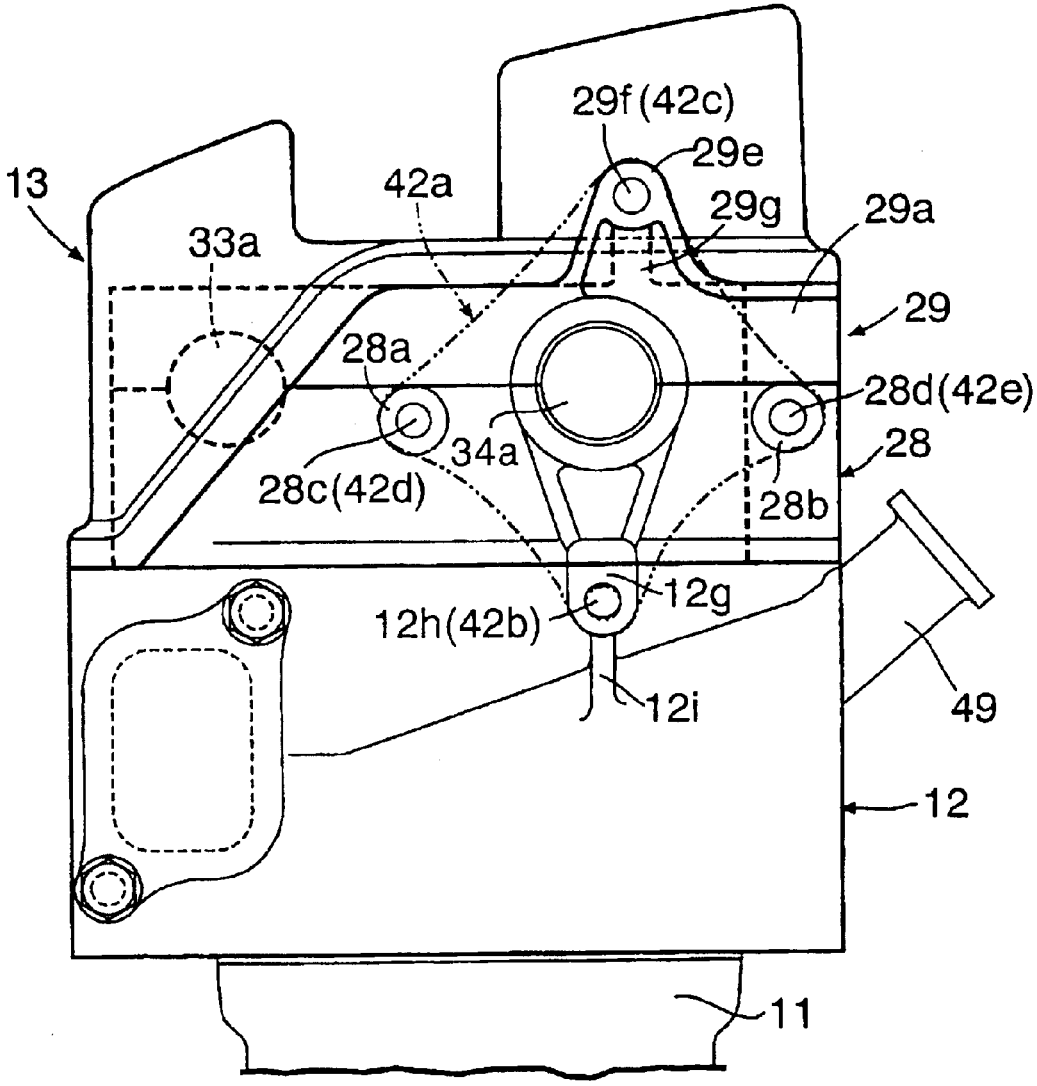
Figure 4:
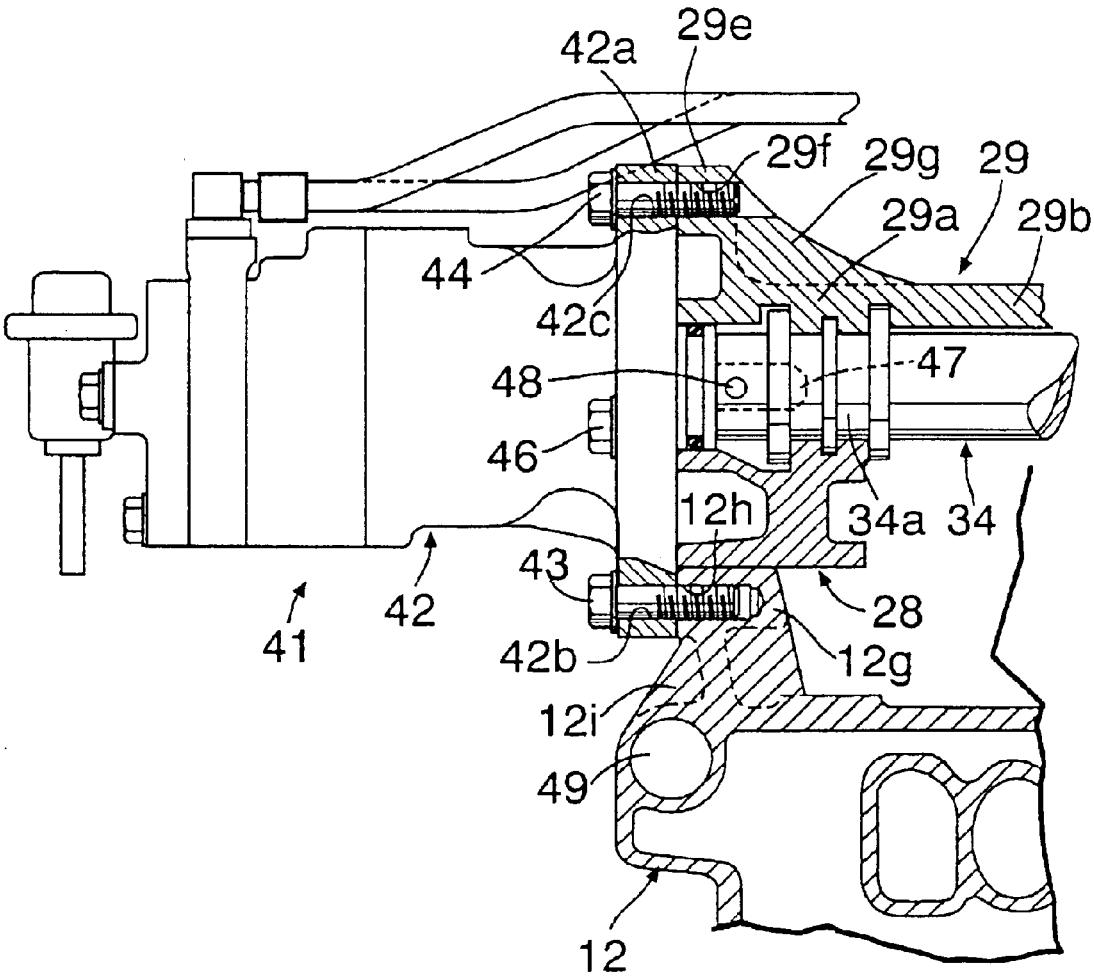
Figure 5:
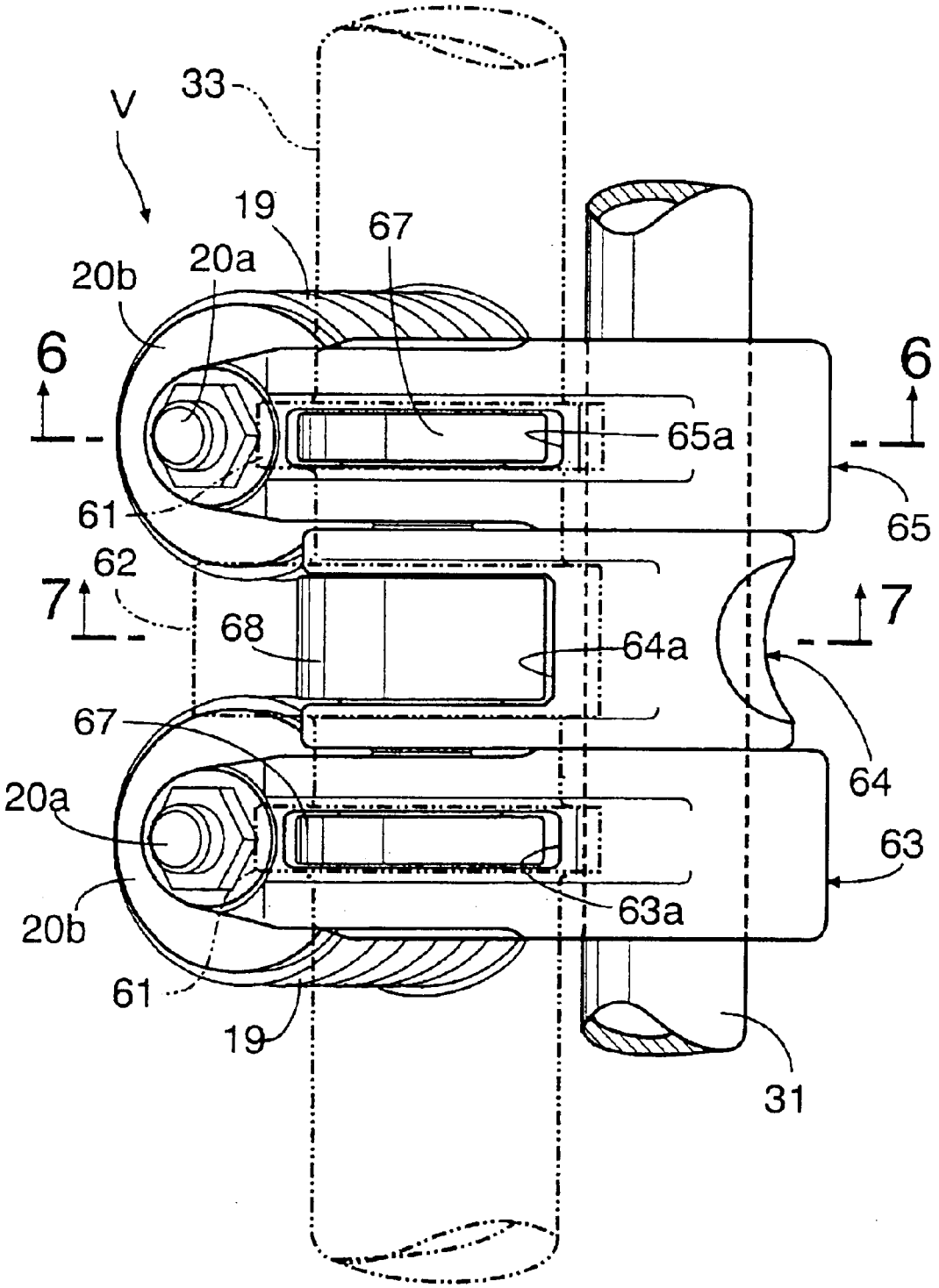
Figure 6:
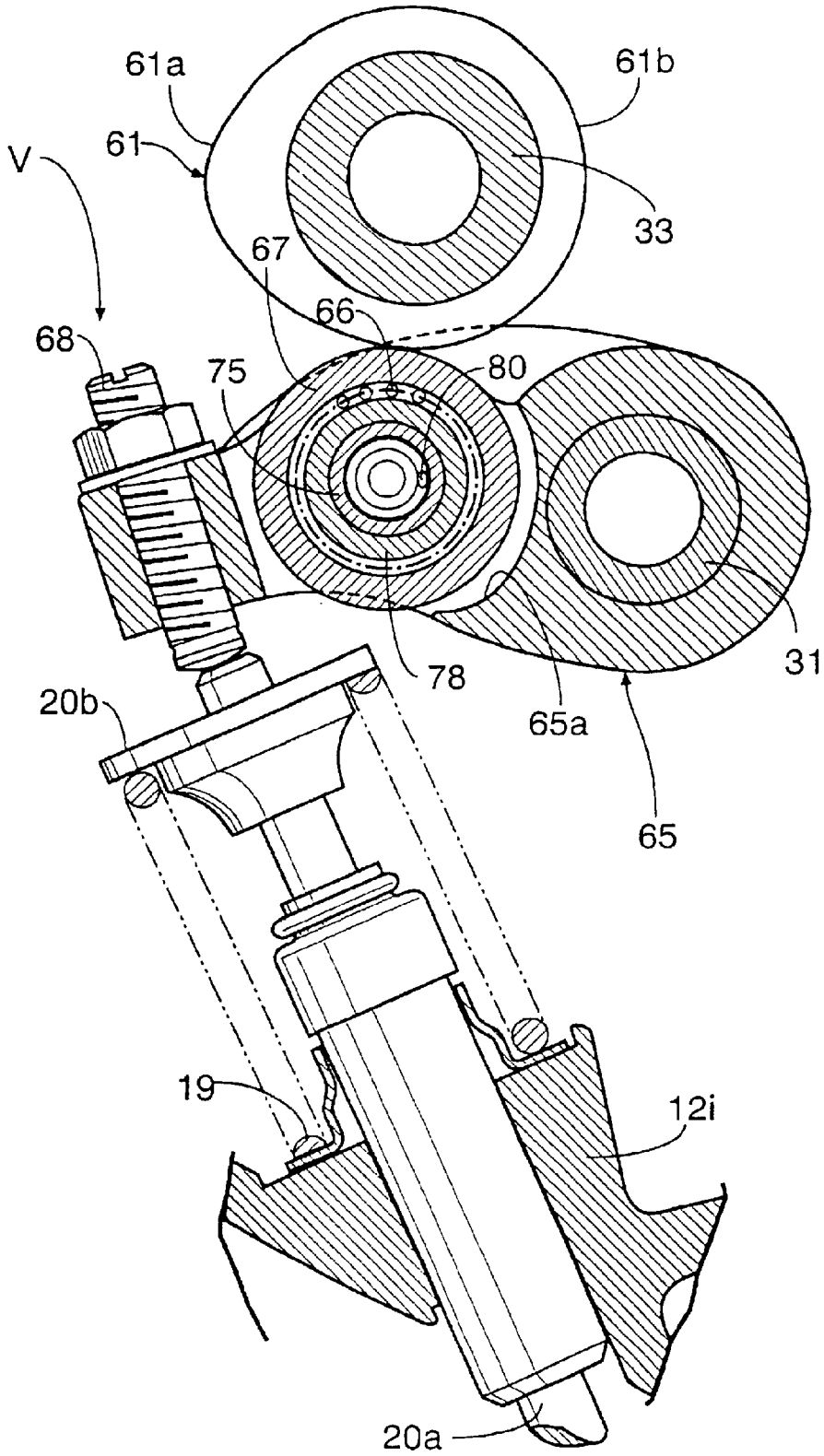
Figure 7:
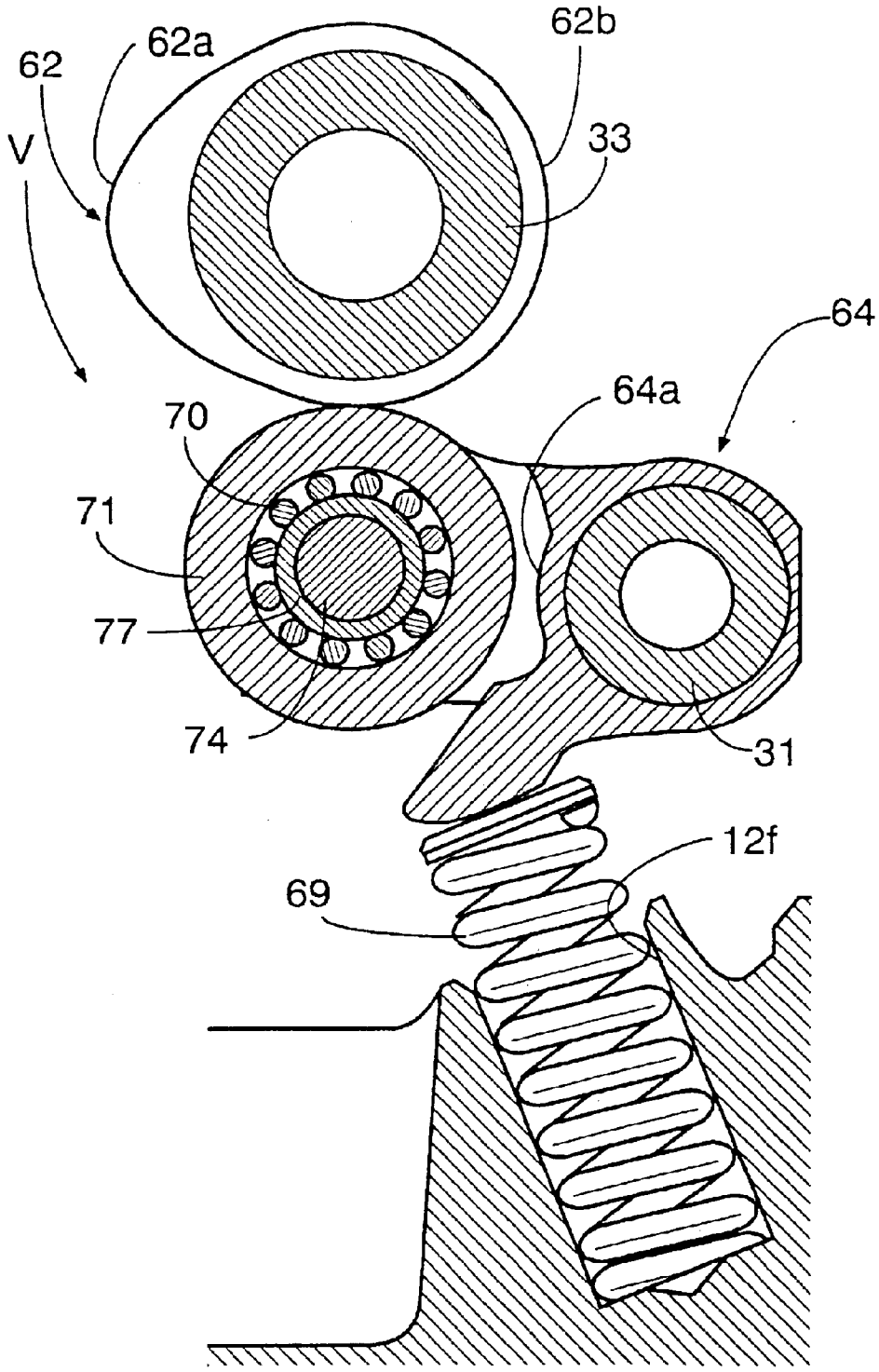

As is clear by referring additionally to FIGS. 2 to 4, a valve operating mechanism housed within the valve operation cam chamber 25, which is surrounded by the head cover 13, includes a rocker shaft holder 28 and an integral type camshaft holder 29. The rocker shaft holder 28 and the integral type camshaft holder 29 are superimposed on the upper surface of the cylinder head 12 and fixed by means of bolts 30. An intake rocker shaft 31 and an exhaust rocker shaft 32 are fixed in the rocker shaft holder 28. An intake camshaft 33 and an exhaust camshaft 34 are rotatably supported between the rocker shaft holder 28 and the integral type camshaft holder 29. The intake camshaft 33 and the exhaust camshaft 34 are driven by a crankshaft via an endless chain.

The integral type camshaft holder 29 connected to the upper surface of the rocker shaft holder 28 and supporting the intake camshaft 33 and the exhaust camshaft 34 has five bearings 29*a* that each support one of five journals of each of the intake camshaft 33 and the exhaust camshaft 34, and four connecting parts 29*b* that integrally connect these bearings 29*a*. Injector insertion openings 29*d*, through which injector pipes 26 run, are formed in the central parts of the four connecting parts 29*b* of the integral type camshaft holder 29, and the gaps between the outer peripheries of the injector pipes 26 and the inner peripheries of the injector insertion openings 29*d* are sealed with sealing members 35.

A recess 13*a* extending in the direction in which the cylinders are arranged is formed downward in the center of the head cover 13. Oil separating chambers 13*b* and 13*c* are formed with partitions 36 on the intake side and the exhaust side, respectively, on either side of the recess 13*a*. The outer periphery of the lower surface of the head cover 13 is supported on the outer periphery of the upper surface of the cylinder head 12 via a first sealing member 37. The inner periphery of the lower surface of the head cover 13, that is, the lower edge of the recess 13*a*, is supported on the upper surface of the integral type camshaft holder 29 via a second sealing member 38. The valve operation cam chamber 25 is thus sealed from the outside air via the first sealing member 37 and the second sealing member 38, and the integral type camshaft holder 29 forms a part of the roof of the valve operation cam chamber 25.

A fuel pipeline 39 is housed within the recess 13*a* of the cylinder head 13 and fixed by means of four bolts 40 to the upper ends of the four injectors 27 projecting into the recess 13*a* from the injector insertion openings 29*d* of the integral type camshaft holder 29. On one end surface of the engine E, the rocker shaft holder 28 and the integral type camshaft holder 29 are exposed outside the head cover 13, and a journal 33*a* at the shaft end of the intake camshaft 33 and a journal 34*a* at the shaft end of the exhaust camshaft 34 are rotatably supported in both the rocker shaft holder 28 and the bearing 29*a* of the integral type camshaft holder 29. In order to supply fuel at high pressure to the injectors 27 via the fuel pipeline 39, the fuel pump 41, which is driven by the shaft end of the exhaust camshaft 34, is mounted so as to extend over the three members consisting of the cylinder head 11, the rocker shaft holder 28 and the integral type camshaft holder 29.

That is, the fuel pump 41, which is an axial plunger pump, has a pump housing 42, and four bolt holes 42*b* to 42*e* are formed in a mounting flange 42*a* of the pump housing 42. A bolt 43 that runs through the first bolt hole 42*b* at the lowest position is tightened into a bolt hole 12*h* of a fuel pump mounting boss 12*g* formed on the end surface of the cylinder head 12. A bolt 44 that runs through the second bolt hole 42*c* at the highest position is tightened into a bolt hole 29*f* of a fuel pump mounting boss 29*e* that projects upward from the bearing 29*a* of the integral type camshaft holder 29. Bolts 45 and 46 that run through the third bolt hole 42*d* and the fourth bolt hole 42*e* positioned between the highest and lowest positions are tightened into bolt holes 28*c* and 28*d* of fuel pump mounting bosses 28*a* and 28*b* of the rocker shaft holder 28. A pump shaft 47 of the fuel pump 41 thus fixed by means of the four bolts 43 to 46 is fitted coaxially to the shaft end of the exhaust camshaft 34 and joined to it by means of a pin 48.

An EGR gas passage 49 extends from the cylinder head side wall 12*c* on the exhaust side into the interior of the cylinder head 12. An outer wall of the EGR gas passage 49 and the fuel pump mounting boss 12*g* of the cylinder head 12 are connected to each other via a reinforcing rib 12*i* (FIGS. 3 and 4). A reverse surface of the fuel pump mounting boss 29*e* of the integral type camshaft holder 29 and the upper surface of the bearing 29*a* are connected to each other via a reinforcing rib 29*g* that extends in the direction toward where the fuel pump 41 is mounted (FIGS. 3 and 4).

As shown in FIGS. 5 to 8, a variable valve operating characteristic mechanism V for changing the valve lift and opening angle of the intake valves 20 in two stages is provided in the valve operation cam chamber 25.

On the intake camshaft 33 a pair of low speed cams 61 and a high speed cam 62 interposed between the two low speed cams 61 are provided so as to correspond to each of the cylinders 14. A first intake rocker arm 63, a second intake rocker arm 64 and a third intake rocker arm 65 are swingably supported on the intake rocker shaft 31, which is fixed beneath and parallel to the intake camshaft 33, so as to correspond to the low speed cam 61, the high speed cam 62 and the low speed cam 61, respectively.

The pair of low speed cams 61 have base circles 61*b* and elevations 61*a* that project by a comparatively small amount in the radial direction of the intake camshaft 33. The high speed cam 62 has a base circle 62*b* and an elevation 62*a* that projects by a larger amount and over a wider angle than that of the projection of the elevations 61*a* of the low speed cams 61.

Flanges 20*b* are provided on the upper ends of valve stems 20*a* of the intake valves 20. The intake valves 20 are forced in the closing direction by the valve springs 19 that are installed between the cylinder head 12 and the flanges 20*b* in a compressed state. The first and third rocker arms 63 and 65 are swingably supported around the intake rocker shaft 31 at one of their ends, have rollers 67 that are supported within their cut-outs 63*a* and 65*b* via needle bearings 66 and are in contact with the pair of low speed cams 61, and have tappet screws 68 that are in freely movable contact with the upper ends of the valve stems 20*a* of the intake valves 20 at the other of their ends.

The second intake rocker arm 64, which is disposed between the pair of intake valves 20 and is swingably supported around the intake rocker shaft 31 at one end, has a force applied to it by a compressed lost motion spring 69 mounted in a spring seat 12*f* formed in the cylinder head 12 and has a roller 71 that is supported in a cut-out 64*a* via a needle bearing 70 and is in contact with the high speed cam 62.

Figure 8:
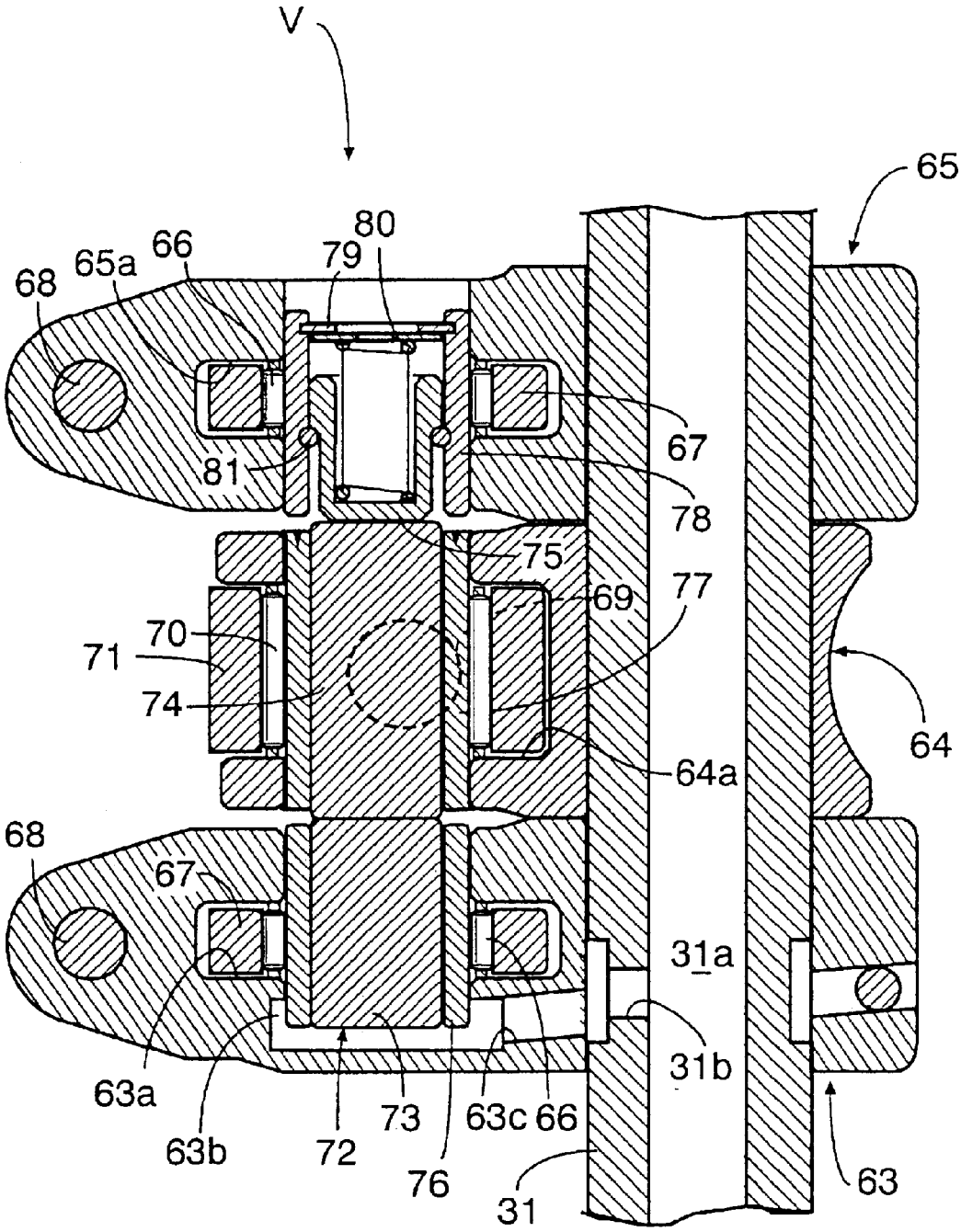

As is clear from FIG. 8, a connection switch-over mechanism 72 for switching over the state of connection between the first, second and third intake rocker arms 63 to 65 has a first switch-over pin 73 that can provide a connection between the first intake rocker arm 63 and the second intake rocker arm 64, a second switch-over pin 74 that can provide a connection between the second intake rocker arm 64 and the third intake rocker arm 65, and a third switch-over pin 75 that restrains the movement of the first switch-over pin 73 and the second switch-over pin 74. The switch-over pins 73 to 75 are slidably supported within sleeves 76 to 78 that are press-fitted into the respective intake rocker arms 63 to 65. The sleeves 76 to 78 form the support shafts for the rollers 67 and 71. The third switch-over pin 75 is made in the form of a cup and is forced toward the first and second switch-over pins 73 and 74 by means of a return spring 80 that is disposed between the third switch-over pin 75 and a spring seat 79 fixed to the sleeve 78.

An oil chamber 63*b* is formed within the first intake rocker arm 63, and one end of the first switch-over pin 73 faces the oil chamber 63*b*. A communicating passage 63*c* that communicates with the oil chamber 63*b* is formed in the first intake rocker arm 63, and a hydraulic pressure supply passage 31*a* is formed in the intake rocker shaft 31. The communicating passage 63*c* and the hydraulic pressure supply passage 31*a* communicate with each other all the time via a communicating passage 31*b* formed in the side wall of the intake rocker shaft 31 regardless of the swinging state of the first intake rocker arm 63.

When the hydraulic pressure supplied to the oil chamber 63*b* is released, the first to third switch-over pins 73 to 75 move to the disconnected side due to the resilient force of the return spring 80, and the third switch-over pin 75 stops at a position where it is in contact with the stopper 81. At this point, since the plane on which the second switch-over pin 74 and the third switch-over pin 75 are in contact with each other is between the second intake rocker arm 64 and the third intake rocker arm 65 and the plane on which the first switch-over pin 73 and the second switch-over pin 74 are in contact with each other is between the first intake rocker arm 63 and the second intake rocker arm 64, the first to third intake rocker arms 63 to 65 are in a non-connected state. When a hydraulic pressure is supplied to the oil chamber 63*b*, the first to third switch-over pins 73 to 75 move to the connected side against the resilient force of the return spring 80, the first switch-over pin 73 of the first intake rocker arm 63 engages with the second intake rocker arm 64 and the second switch-over pin 74 of the second intake rocker arm 64 engages with the third intake rocker arm 65, and the first to third intake rocker arms 63 to 65 are thus connected integrally.

As shown in FIG. 1, one end of the exhaust rocker arm 82 is swingably supported around the exhaust rocker shaft 32. The other, forked, end of the exhaust rocker arm 82 is in contact with the upper end of the valve stem of the exhaust valve 22, and a roller 83 that is provided in the middle section of the exhaust rocker arm 82 is in contact with an exhaust cam 84 that is provided on the exhaust camshaft 34.

The action of the embodiment of the present invention is now explained.

When the variable valve operating characteristic mechanism V establishes a low speed valve timing, no hydraulic pressure is applied to the oil chamber 63*b* that communicates with the hydraulic pressure supply passage 31*a* within the intake rocker shaft 31 and the first to third switch-over pins 73 to 75 move to the disconnected positions shown in FIG. 8 due to the resilient force of the return spring 80. As a result, the first to third intake rocker arms 63 to 65 are isolated from each other, and the two intake valves 20 are operated so as to open and close by the first and third intake rocker arms 63 and 65 whose rollers 67 are in contact with the two low speed cams 61. In this case, the second intake rocker arm 64 whose roller 71 is in contact with the high speed cam 62 moves independently of the action of the intake valves 20 and without effect.

When a hydraulic pressure is applied to the oil chamber 63*b* in order to establish a high speed valve timing, the first to third switch-over pins 73 to 75 move to the connected positions against the resilient force of the return spring 80. Since the first and second switch-over pins 73 and 74 make the first to third intake rocker arms 63 to 65 connect integrally together, the swinging action of the second intake rocker arm 64 whose roller 71 is in contact with the high speed cam 62 having the high and wide-angled elevation 62*a* is transmitted to the first and third intake rocker arms 63 and 65 that are integrally connected to the second intake rocker arm 64 thereby operating the two intake valves 20 so as to open and close them. In this case, the elevations 61*a* of the low speed cams 61 are detached from the rollers 67 of the first and third intake rocker arms 63 and 65 and move without effect.

As hereinbefore described, when the variable valve operating characteristic mechanism V establishes the low speed valve timing, the intake valves 20 are operated with a low valve lift and a small opening angle. When the high speed valve timing is established, the intake valves 20 are operated with a high valve lift and a large opening angle.

The exhaust valves 22 are operated so as to open and close with constant valve lift and opening angle via the exhaust rocker arm 82 by the exhaust cam 84 provided around the exhaust camshaft 34.

When the fuel pump 41 connected to the shaft end of the exhaust camshaft 34, which rotates accompanying the operation of the engine E, is operated, fuel at high pressure supplied via the fuel pipeline 39 is injected into the interiors of the cylinders 14 via the respective injectors 27. Not only is the fuel pump 41 heavy, it also receives a driving torque from the exhaust camshaft 34 and, as a result, a large load is applied to the attachment points of the fuel pump 41. When this load causes any deformation in the end of the integral type camshaft holder 29, it becomes particularly difficult to support the journal 34*a* on the shaft end of the exhaust camshaft 34 in a stable manner thereby causing a possibility that abnormal wear, etc. might occur.

However, since the mounting flange 42*a* of the fuel pump 41 is fastened to the three members consisting of the cylinder head 12, the rocker shaft bolder 28 and the integral type camshaft holder 29 by means of the four bolts 43 to 46 in the present embodiment, the rigidity of the parts on which the fuel pump 41 is mounted is enhanced thereby preventing any deformation of the integral type camshaft holder 29 and the rocker shaft bolder 28. Not only can the intake camshaft 33, the exhaust camshaft 34, the intake rocker shaft 31 and the exhaust rocker shaft 32 be supported reliably, but also the rigidity with which the fuel pump 41 itself is supported can be enhanced. Moreover, since the integral type camshaft holder 29 has a structure in which the plurality of bearings 29*a* that extend in a direction perpendicular to the direction in which the cylinders are arranged are connected integrally together by the plurality of connecting parts 29*b* in the direction in which the cylinders are arranged, the rigidity of the integral type camshaft holder 29 is further enhanced thereby contributing to an increase in the rigidity with which the fuel pump 41 is supported.

Furthermore, since the outer wall of the EGR gas passage 49, which is formed in a tube shape and has high rigidity, is connected to the fuel pump mounting boss 12*g* of the cylinder head 12 via the reinforcing rib 12*i*, the fuel pump mounting boss 12*g* is reinforced, thus further enhancing the rigidity with which the fuel pump 41 is supported. Furthermore, since the reverse surface of the fuel pump mounting boss 29*e* of the integral type camshaft holder 29 is connected to the upper surface of the bearing 29*a* via the reinforcing rib 29*g*, it becomes possible to suppress downward movement of the integral type camshaft holder 29 due to the weight of the fuel pump 41, and the rigidity with which the fuel pump 41, the intake camshaft 33 and the exhaust camshaft 34 are supported can be further enhanced. In particular, since the reinforcing rib 29*g* of the reverse surface of the fuel pump mounting boss 29*e* extends to the bearing 29*a* of the integral type camshaft holder 29, the effect of enhancing the rigidity can be further increased.

Although an embodiment of the present invention has been explained in detail above, the present invention can be modified in a variety of ways without departing from the spirit and scope of the present invention.

For example, the present invention can also be applied to an engine having no variable valve operating characteristic mechanism V and to an in-line engine or a V-type engine other than a four cylinder type. Furthermore, a DOHC type engine has been illustrated in the present embodiment, but the present invention can be applied to an SOHC type engine.

Furthermore, the rocker shafts 31 and 32 are supported in the rocker shaft holder 28 and the camshafts 33 and 34 are supported between the rocker shaft holder 28 and the integral type camshaft holder 29 in the embodiment, but while supporting the rocker shafts 31 and 32 in the rocker shaft holder 28, the camshafts 33 and 34 can be supported in the integral type camshaft holder 29, or the rocker shafts 31 and 32 can be supported between the rocker shaft holder 28 and the integral type camshaft holder 29 while supporting the camshafts 33 and 34 in the integral type camshaft holder 29. Moreover, although the fuel pump 41 is driven by the exhaust camshaft 34 in the embodiment, it can be driven by the intake camshaft 33.

What is claimed is:

1. An engine fuel pump mounting structure for an engine having a camshaft which is supported on an upper surface of a cylinder head by cooperation of the cylinder head with a camshaft holder which is fixed to the upper surface of the cylinder head, and a fuel pump which is driven by said camshaft, said mounting structure comprising:

a plurality of longitudinally spaced bearings operative to support said camshaft, said bearings being connected together via integrally formed connecting parts to form said camshaft holder, and fastening means for attaching said fuel pump to an end of said camshaft holder, wherein each of said connecting parts is provided at a position on that side of a plane including an axis of the camshaft and extending perpendicularly to an axis of a cylinder which side is away from a combustion chamber, said connecting part being entirely outside the axis of the camshaft as viewed in the direction of the cylinder axis.

2. An engine fuel pump mounting structure for an engine having a camshaft which is supported on an upper surface of a cylinder head by cooperation of the cylinder head with a camshaft holder which is fixed to the upper surface of the cylinder head, and a fuel pump which is driven by said camshaft, said mounting structure comprising:

a plurality of bearings operative to support said camshaft, connecting parts operative to connect said bearings together to form said camshaft holder, and fastening means for attaching said fuel pump to an end of said camshaft holder, wherein a fuel pump mounting boss is formed on the cylinder head and an outer wall of an EGR gas passage is formed in the cylinder head, said fuel pump mounting boss and said outer wall of said EGR gas passage being connected to each other via a reinforcing rib.

3. The engine fuel pump mounting structure according to claim 2 wherein a further fuel pump mounting boss is formed on the camshaft holder, and a further reinforcing rib is provided on a reverse surface of said further fuel pump mounting boss extending in a mounting direction of said fuel pump.

4. An engine fuel pump mounting structure for an engine having a camshaft which is supported on an upper surface of a cylinder head by cooperation of the cylinder head with a camshaft holder which is fixed to the upper surface of the cylinder head, and a fuel pump which is driven by said camshaft, said mounting structure comprising:

a plurality of bearings operative to support said camshaft, connecting parts operative to connect said bearings together to form said camshaft holder, and fastening means for attaching said fuel pump to an end of said camshaft holder, wherein a fuel pump mounting boss is formed on the camshaft holder, and a reinforcing rib is provided to extend from a reverse surface of said fuel pump mounting boss extending in a mounting direction of said fuel pump.

5. An engine fuel pump mounting structure in which a rocker shaft holder that supports a rocker shaft and a camshaft holder that supports a camshaft alone or in association with the rocker shaft holder are superimposed on an upper surface of a cylinder head, and a fuel pump is mounted on a shaft end of the camshaft, said engine fuel pump mounting structure comprising:

a plurality of bearings that support the camshaft being integrally connected together via connecting parts to form the camshaft holder, and the fuel pump being fastened to each of the cylinder head, the rocker shaft holder and the camshaft holder by bolts.

6. The engine fuel pump mounting structure according to claim 5 wherein a fuel pump mounting boss is formed on the cylinder head and an outer wall of an EGR gas passage is formed in the cylinder head, and a reinforcing rib connects said fuel pump mounting boss and said outer wall of said EGR gas passage to each other.

7. The engine fuel pump mounting structure according to claim 6 wherein a further fuel pump mounting boss is formed on the camshaft holder, and a further reinforcing rib is provided to extend from a reverse surface of said further fuel pump mounting boss extending in a mounting direction of said fuel pump.

8. The engine fuel pump mounting structure according to claim 5 wherein a fuel pump mounting boss is formed on the camshaft holder, and a reinforcing rib is provided to extend from a reverse surface of said fuel pump mounting boss extending in a mounting direction toward a fuel pump.

9. An engine fuel pump mounting structure, comprising:

a cylinder head, a camshaft holder fixed to an upper surface of said cylinder head, a camshaft supported by said camshaft holder, and a fuel pump mounted on an end of said camshaft, said engine fuel pump mounting structure further including:

a bearing provided on the camshaft holder, a fuel pump mounting boss provided on the camshaft holder, and a reinforcing rib connecting said bearing and said fuel pump mounting boss to each other, wherein a further fuel pump mounting boss is formed on the cylinder head, an outer wall of the cylinder head containing an EGR gas passage formed therein, and said further reinforcing rib connects said fuel pump mounting boss and said outer wall of said EGR gas passage to each other.

10. The engine fuel pump mounting structure according to claim 9 wherein the reinforcing rib which connects the bearing to the fuel pump mounting boss formed on the camshaft holder extends from a reverse side of the fuel pump mounting boss in the mounting direction of the fuel pump.

11. An engine fuel pump mounting structure for an engine having a lower shaft holder provided on an upper surface of a cylinder head, an upper shaft holder superimposed on said lower shaft holder, a camshaft supported on the upper surface of the cylinder head by cooperation of the upper and lower shaft holders, and a fuel pump which is driven by said camshaft, said mounting structure comprising:

a plurality of bearings operative to support said camshaft, connecting parts operative to connect said bearings together to form said upper shaft holder, and fastening means for attaching said fuel pump to each of said cylinder head, said upper shaft holder and said lower shaft holder.

12. An engine fuel pump mounting structure for an engine having a camshaft supported on an upper surface of a cylinder head, and a fuel pump which is driven by said camshaft, said mounting structure comprising:

a plurality of bearings operative to support said camshaft, connecting parts operative to connect said bearings together to form a camshaft holder, and fastening means for attaching said fuel pump to an end of said camshaft holder, wherein formed on the cylinder head is a fuel pump mounting boss and an outer wall of an EGR gas passage, said fuel pump mounting boss and said outer wall of said EGR gas passage being connected to each other via a reinforcing rib.

13. An engine fuel pump mounting structure for an engine having a camshaft supported on an upper surface of a cylinder head, and a fuel pump which is driven by said camshaft, said mounting structure comprising:

a plurality of bearings operative to support said camshaft, connecting parts operative to connect said bearings together to form a camshaft holder, and fastening means for attaching said fuel pump to an end of said camshaft holder, wherein a fuel pump mounting boss is formed on the camshaft holder, a reinforcing rib is provided to extend from a reverse surface of said fuel pump mounting boss in a direction of a cylinder array of the engine toward an inner side of the engine and is located at a position upwardly of an axis of said camshaft as viewed in an axial direction of a cylinder.

14. The engine fuel pump mounting structure according to claim 12 wherein said fuel pump mounting boss is formed on the camshaft holder, a further reinforcing rib is provided to extend from a reverse surface of said fuel pump mounting boss in a direction of a cylinder array of the engine toward an inner side of the engine and is located at a position upwardly of an axis of said camshaft as viewed in an axial direction of a cylinder.

15. An engine fuel pump mounting structure, comprising:

a cylinder head, a camshaft holder fixed to an upper surface of said cylinder head, a camshaft supported by said camshaft holder, and a fuel pump mounted on an end of said camshaft, said engine fuel pump mounting structure further including:

a bearing provided on the camshaft holder, a fuel pump mounting boss provided on the camshaft holder, and a reinforcing rib connecting said bearing and said fuel pump mounting boss to each other, wherein the reinforcing rib extends from a reverse side of the fuel pump mounting boss in the mounting direction of the fuel pump along a cylinder array of the engine toward an inner side of the engine and is located at a position upwardly of an axis of said camshaft as viewed in an axial direction of a cylinder.

16. An engine fuel pump mounting structure in which a rocker shaft holder that supports a rocker shaft and a camshaft holder that supports a camshaft are superimposed on an upper surface of a cylinder head, and a fuel pump is mounted on a shaft end of the camshaft, said engine fuel pump mounting structure comprising:

a plurality of bearings that support the camshaft being integrally connected together via connecting parts to form the camshaft holder, and the fuel pump being fastened to each of the cylinder head, the rocker shaft holder and the camshaft holder by bolts.

17. The engine fuel pump mounting structure according to claim 1, wherein said engine has a plurality of camshafts as said camshaft which are supported by said camshaft holder, said connecting parts being positioned between said plurality of camshafts as viewed in the direction of the cylinder axis.

18. The engine fuel pump mounting structure according to claim 1, wherein an injector insertion opening, through which an injector pipe runs, is formed in a central part of the connecting part.

19. The engine fuel pump mounting structure according to claim 17, wherein an injector insertion opening, through which an injector pipe runs, is formed in a central part of the connecting part.

20. The engine fuel pump mounting structure according to claim 18, wherein an outer periphery of the injector pipe and an inner periphery of the injector insertion opening are sealed with a sealing member.

21. The engine fuel pump mounting structure according to claim 19, wherein an outer periphery of the injector pipe and an inner periphery of the injector insertion opening are sealed with a sealing member.

22. The engine fuel pump mounting structure according to claim 1, wherein a fuel piping for supplying fuel to an injector is fixed to the camshaft holder.

23. The engine fuel pump mounting structure according to claim 17, wherein a fuel piping for supplying fuel to an injector is fixed to the camshaft holder.

24. An engine fuel pump mounting structure for an engine having a camshaft which is supported on an upper surface of a cylinder head by cooperation of the cylinder head with a camshaft holder which is fixed to the upper surface of the cylinder head, and a fuel pump which is driven by said camshaft, said mounting structure comprising:

a plurality of longitudinally spaced bearings operative to support said camshaft, said bearings being connected together via integrally formed connecting parts to form said camshaft holder, and fastening means for attaching said fuel pump to an end of said camshaft holder, wherein each of said connecting parts is provided at a position on that side of a plane including an axis of the camshaft and extending perpendicularly to an axis of a cylinder which side is away from a combustion chamber and, when viewed in a direction perpendicular to the axis of the camshaft as well as perpendicular to the axis of the cylinder, at a position where a cam provided on the camshaft is at least partly overlapped with the connection part, said connecting part being entirely at a position outside the axis of the camshaft as viewed in the direction of the cylinder axis.

* * * * *